US010246301B2

(12) United States Patent
Dominguez et al.

(10) Patent No.: US 10,246,301 B2
(45) Date of Patent: Apr. 2, 2019

(54) BATTERY INSTALLED IN ELEVATOR CAR

(71) Applicants: OTIS ELEVATOR COMPANY, Farmington, CT (US); Franck Dominguez, Gien (FR)

(72) Inventors: Franck Dominguez, Loiret (FR); Nicolas Guillot, Coullons (FR); Frederic Beauchaud, Coullons (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/500,137

(22) PCT Filed: Jul. 31, 2014

(86) PCT No.: PCT/IB2014/001698
§ 371 (c)(1),
(2) Date: Jan. 30, 2017

(87) PCT Pub. No.: WO2016/016679
PCT Pub. Date: Feb. 4, 2016

(65) Prior Publication Data

US 2017/0260026 A1 Sep. 14, 2017

(51) Int. Cl.
*B66B 9/00* (2006.01)
*B66B 11/02* (2006.01)
*B66B 19/00* (2006.01)

(52) U.S. Cl.
CPC ..... *B66B 11/0246* (2013.01); *B66B 9/00* (2013.01); *B66B 11/0226* (2013.01); *B66B 11/0233* (2013.01); *B66B 19/00* (2013.01)

(58) Field of Classification Search
CPC ..... B66B 11/0226; B66B 11/0233; B66B 11/0246
See application file for complete search history.

(56) References Cited

U.S. PATENT DOCUMENTS 4,756,978 A * 7/1988 Nitcher ..... H01M 2/1077 180/68.5
7,568,557 B2 * 8/2009 Rossignol ..... B66B 11/0226 187/277

FOREIGN PATENT DOCUMENTS

CN 2054784 U 3/1990
CN 1073653 A 6/1993
(Continued)

OTHER PUBLICATIONS

English Machine Translation of JP 2002-037573.*
(Continued)

*Primary Examiner* — Diem M Tran
(74) *Attorney, Agent, or Firm* — Cantor Colburn LLP

(57) ABSTRACT

An elevator system includes a hoistway and an elevator car suspended in the hoistway via a suspension member and drivable along the hoistway. The elevator car includes an elevator car panel and a battery pocket positioned in the elevator car panel. A battery is removably positioned in the battery pocket. The battery and the battery pocket are configured such that inspection, maintenance and/or repair of the battery is performed without entry into the hoistway of the elevator system. A method of servicing an elevator system includes driving an elevator car along a hoistway and stopping the elevator car near a selected elevator landing floor. A battery is at least partially removed from a battery pocket at the elevator car via a technician located at the selected elevator landing floor for inspection, maintenance, replacement and/or repair.

15 Claims, 6 Drawing Sheets

(56) References Cited

FOREIGN PATENT DOCUMENTS

| | | | | | |
|---|---|---|---|---|---|
| CN | 1555335 | A | | 12/2004 | |
| EP | 1864932 | A1 | * | 12/2007 | ..... B66B 1/34 |
| EP | 2727875 | A1 | | 5/2014 | |
| JP | 2002037573 | A | | 2/2002 | |
| JP | 2005145652 | A | * | 6/2005 | |
| JP | 2014118277 | A | | 6/2014 | |
| WO | 0179104 | | | 10/2001 | |

OTHER PUBLICATIONS

Notification of Transmittal of the International Search Report and the Written Opinion of the International Searching Authority, or the Declaration; Application No. PCT/IB2014/001708; dated Mar. 19, 2015; 11 pages.

Chinese Office Action Issued in CN Application No. 201480080949.5, dated Jul. 17, 2018, 8 Pages.

* cited by examiner

BATTERY INSTALLED IN ELEVATOR CAR

CROSS REFERENCE TO RELATED APPLICATIONS

This application claims priority to PCT Patent Application No. PCT/IB14/01698 filed Jul. 31, 2014, the entire contents of which is incorporated herein by reference.

BACKGROUND OF THE INVENTION

The subject matter disclosed herein relates to elevator systems. More particularly, the present disclosure relates to maintenance of elevator system components.

A typical elevator system includes an elevator car that moves along a hoistway. The elevator system includes one or more batteries to provide electrical power to the elevator system for, in some cases, emergency power, emergency lighting or the like. Some elevator systems may further utilize battery power to drive movement of the elevator car along the hoistway in some modes of operation. The batteries typically are located in the hoistway and are connected to the elevator car via electrical leads. As such, to perform maintenance on and/or replace the batteries, a technician must enter the hoistway. Such entry requires that certain safety systems be in place, and that a specified safety volume and clearance space be provided for the technician. Moreover, stopping elevator system operation and entering the hoistway to perform service and or maintenance tasks is time-consuming and costly.

Further, regulatory bodies have specified necessary increases in safety volume and clearance for technicians entering the hoistway resulting in a larger overall volume of the elevator systems, while elevator system customers desire that the elevator system occupy a smaller overall volume.

BRIEF DESCRIPTION OF THE INVENTION

In one embodiment, an elevator car for an elevator system includes an elevator car panel and a battery pocket positioned in the elevator car panel. A battery is removably positioned in the battery pocket. The battery and battery pocket are configured such that inspection, maintenance and/or repair of the battery is performed without entry into a hoistway of the elevator system.

Alternatively or additionally, in this or other embodiments the battery pocket is positioned at a floor panel of the elevator car.

Alternatively or additionally, in this or other embodiments multiple batteries are positioned at the elevator car panel.

Alternatively or additionally, in this or other embodiments the battery supplies electrical power to the elevator car.

Alternatively or additionally, in this or other embodiments the electrical power is for elevator car lighting and/or control systems.

In another embodiment, an elevator system includes a hoistway and an elevator car suspended in the hoistway via a suspension member and drivable along the hoistway. The elevator car includes an elevator car panel and a battery pocket positioned in the elevator car panel. A battery is removably positioned in the battery pocket. The battery and the battery pocket are configured such that inspection, maintenance and/or repair of the battery is performed without entry into the hoistway of the elevator system.

Alternatively or additionally, in this or other embodiments the battery pocket is positioned at a floor panel of the elevator car.

Alternatively or additionally, in this or other embodiments the battery is removable from the battery pocket by a technician at a landing floor of the elevator system.

Alternatively or additionally, in this or other embodiments the elevator system further includes a handle located at the battery for removal of the battery from the battery pocket.

Alternatively or additionally, in this or other embodiments multiple batteries are disposed at the elevator car panel.

Alternatively or additionally, in this or other embodiments the battery supplies electrical power to the elevator car.

Alternatively or additionally, in this or other embodiments the electrical power is for elevator car lighting and/or control systems.

In yet another embodiment, a method of servicing an elevator system includes driving an elevator car along a hoistway and stopping the elevator car near a selected elevator landing floor. A battery is at least partially removed from a battery pocket at the elevator car via a technician located at the selected elevator landing floor for inspection, maintenance, replacement and/or repair.

Alternatively or additionally, in this or other embodiments, the method further includes stopping the elevator car a distance above the selected elevator landing floor and at least partially removing the battery from the battery pocket disposed at a floor panel of the elevator car for inspection, maintenance, replacement and/or repair.

Alternatively or additionally, in this or other embodiments the battery supplies electrical power to the elevator car for one or more of lighting and/or control systems.

The detailed description explains the invention, together with advantages and features, by way of examples with reference to the drawings.

DETAILED DESCRIPTION OF THE INVENTION

Figure 1A:
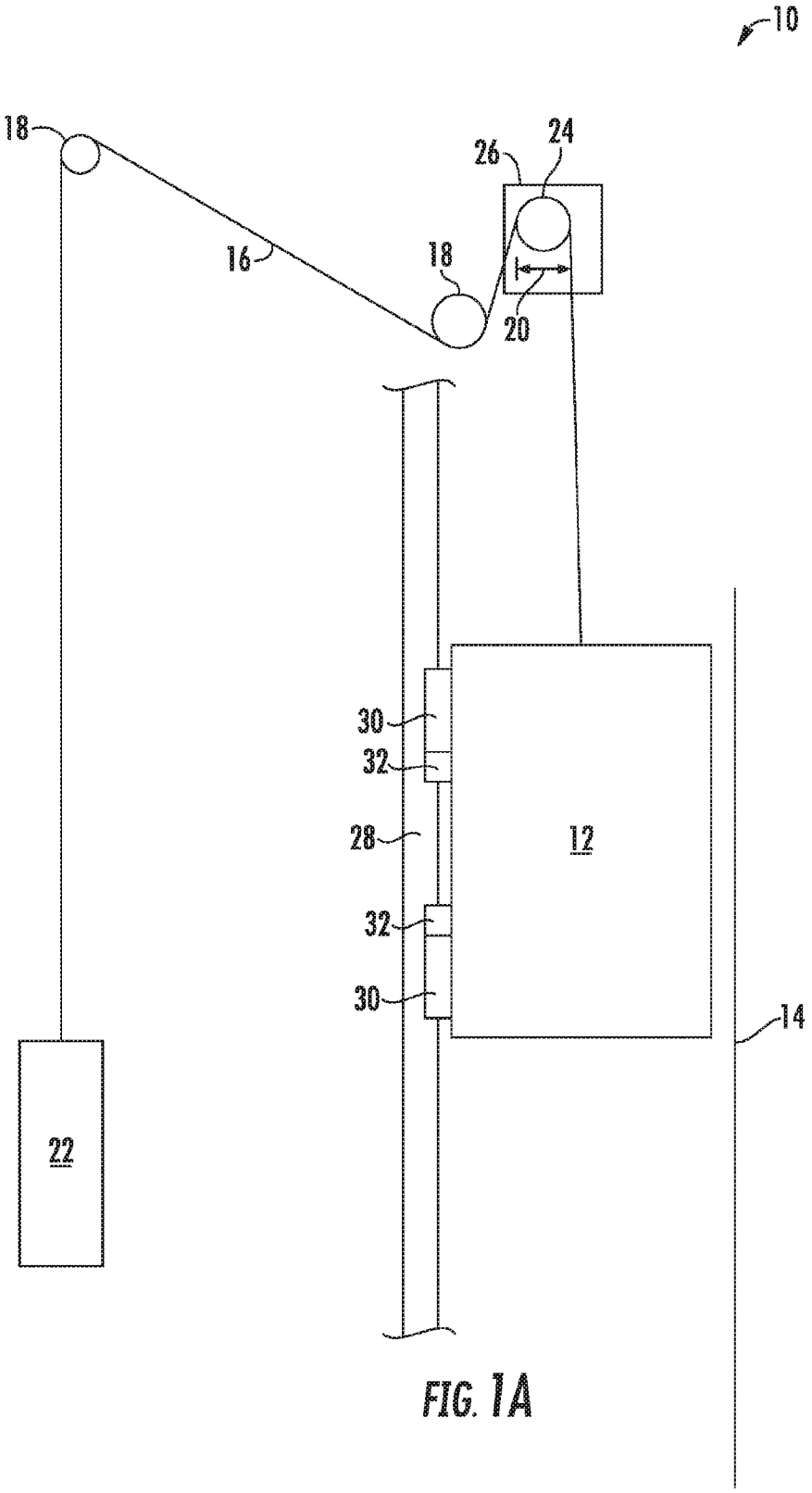
FIG. 1A is a schematic of an exemplary elevator system having a 1:1 roping arrangement.
Figure 1B:
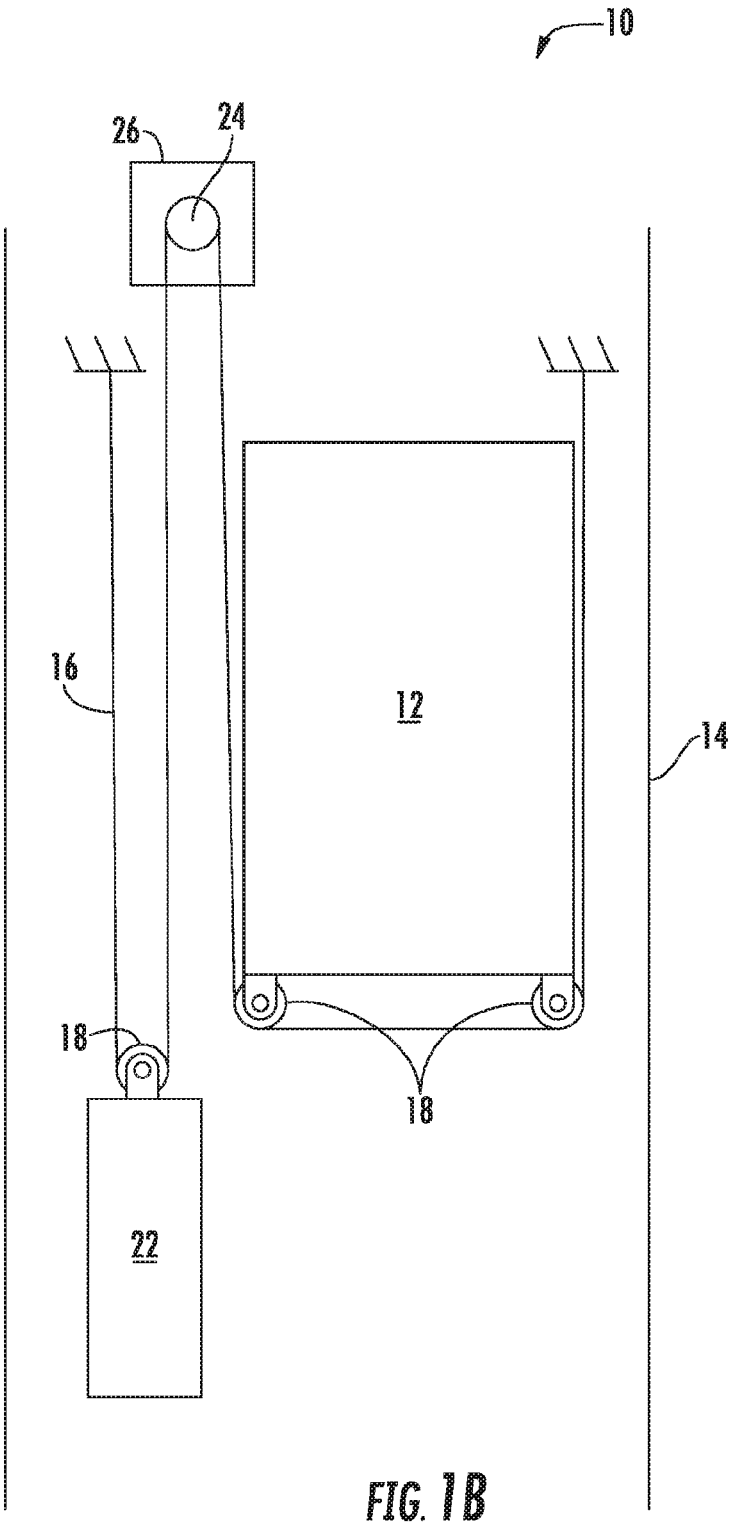
FIG. 1B is a schematic of another exemplary elevator system having a different roping arrangement.
Figure 1C:
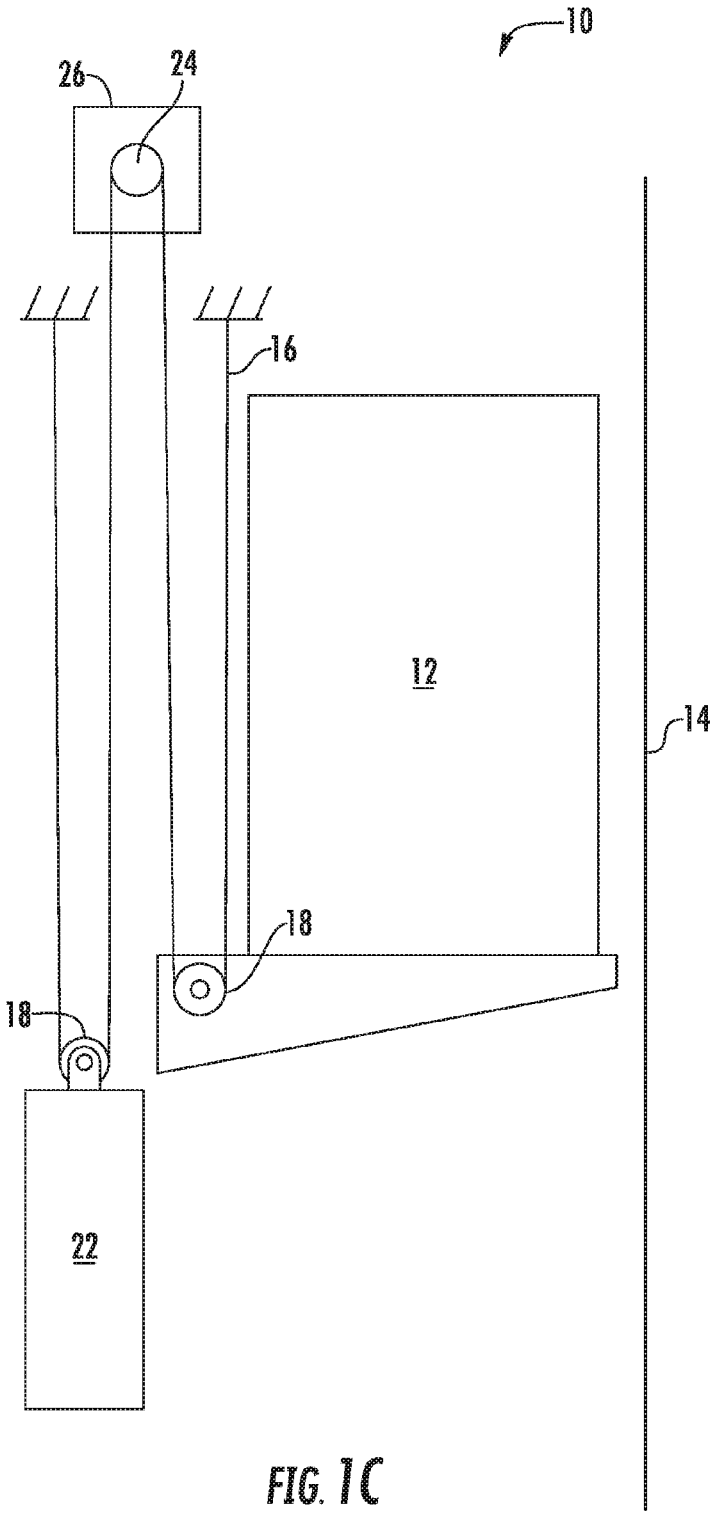
FIG. 1C is a schematic of another exemplary elevator system having a cantilevered arrangement.

Shown in FIGS. 1A, 1B and 1C are schematics of exemplary traction elevator systems 10. The elevator system 10 includes an elevator car 12 operatively suspended or supported in a hoistway 14 with one or more suspension members 16, such as ropes or belts. The one or more suspension members 16 interact with one or more sheaves 18 to be routed around various components of the elevator system 10. The one or more sheaves 16 could also be connected to a counterweight 22, which is used to help balance the elevator system 10 and reduce the difference in belt tension on both sides of a traction sheave 24 during operation.

The sheaves 18 each have a diameter 20, which may be the same or different than the diameters of the other sheaves 18 in the elevator system 10. At least one of the sheaves could be a traction sheave 24. The traction sheave 24 is driven by a machine 26. Movement of the traction sheave 24 by the machine 26 drives, moves and/or propels (through traction) the one or more belts 16 that are routed around the traction sheave 24.

Referring again to FIG. 1A, the elevator system 10 further includes one or more guide rails 28 to guide the elevator car 12 along the hoistway 14. The elevator car includes one or more guide shoes 30 interactive with the guide rails 28 to guide the elevator car 12, and also may include safeties 32 interactive with the guide rail 28 to slow and/or stop motion of the elevator car 12 under certain conditions, such as an overspeed condition.

Figure 2:
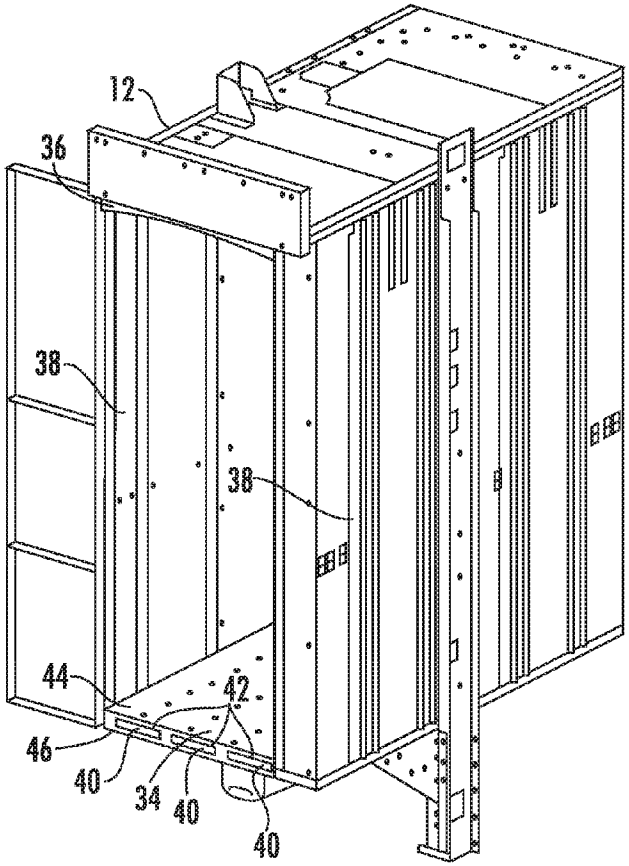
FIG. 2 is a perspective view of an embodiment of an elevator car for an elevator system.

Referring now to FIG. 2, the elevator car 12 generally includes a floor 34, a ceiling 36 and one or more wall panels 38. To provide electrical power to the elevator car 12 for lighting, controls, drive or other functions, a number of electrical cells, or batteries 40 are provided and installed at the elevator car 12. For example, as shown, in some embodiments the batteries 40 are installed in the floor 34 of the elevator car 12, in battery pockets 42 located between an upper floor panel 44 and a lower floor panel 46 of the floor 34. While the batteries 40 are illustrated as located in the floor 34 of the elevator car 12, in other embodiments batteries 40 may be installed in the ceiling 36 and/or the wall panels 38. Further, while three batteries 40 are illustrated, other quantities of batteries 40, such as two, four or five batteries 40 are contemplated within the scope of the present disclosure.

Figure 3:
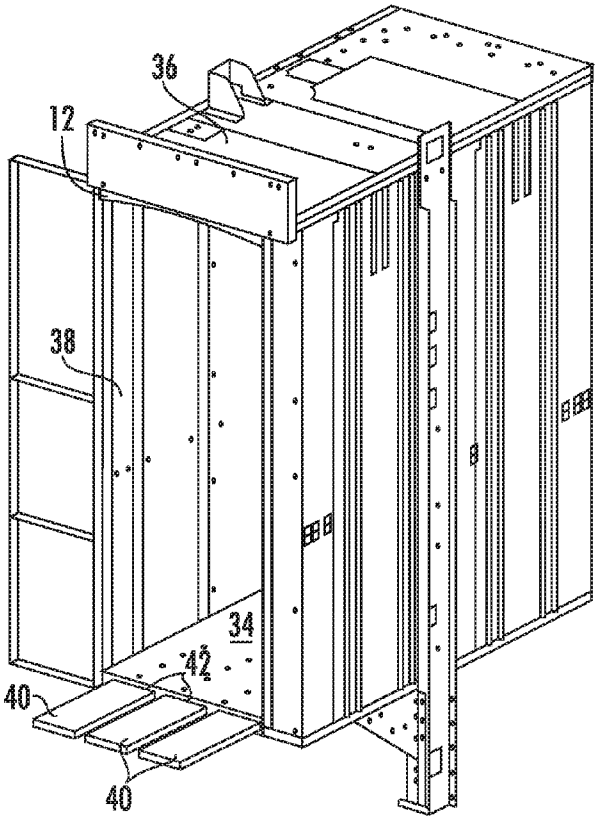
FIG. 3 is another perspective view of an embodiment of an elevator car for an elevator system.
Figure 4:
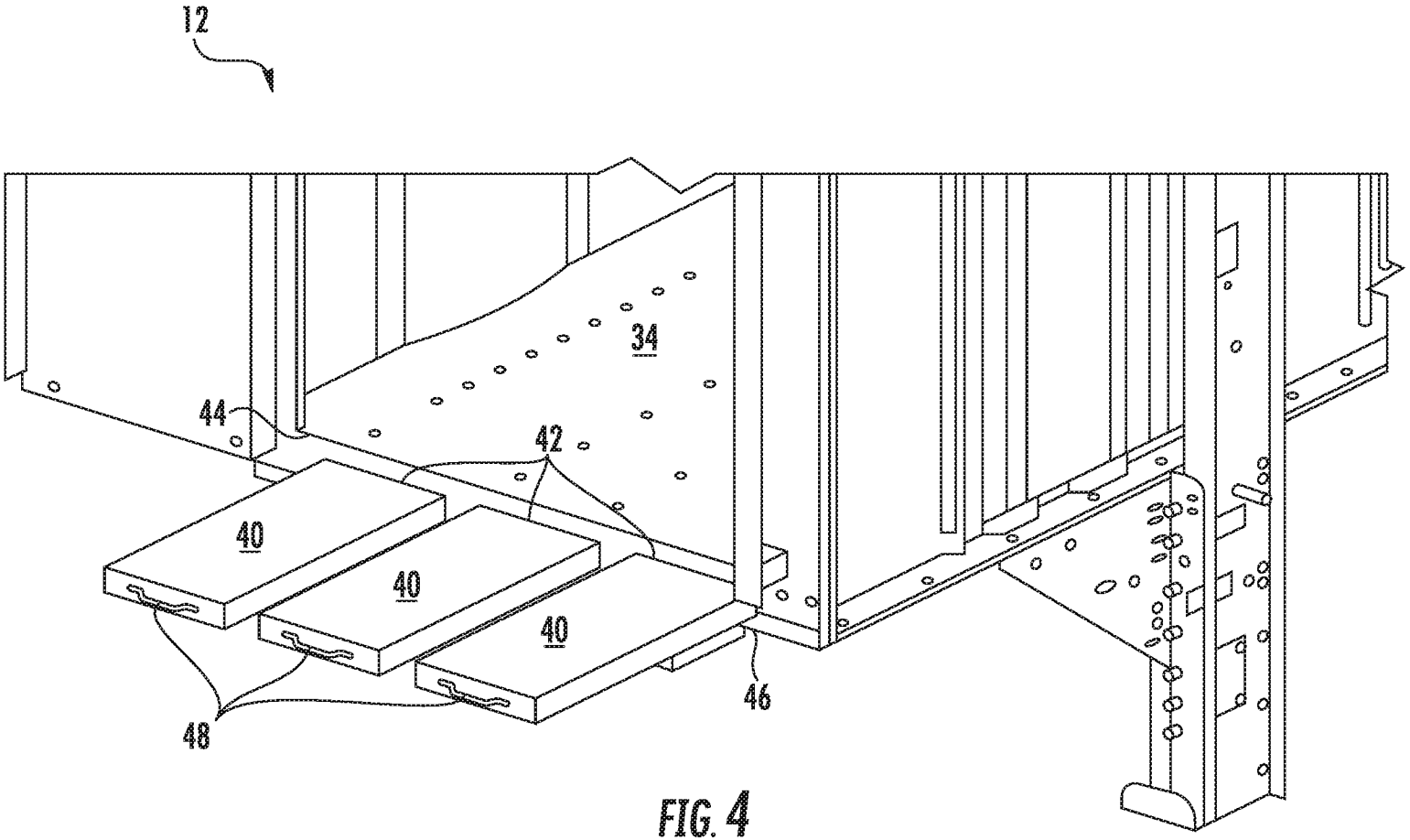
FIG. 4 is a perspective view of an embodiment of a floor panel of an elevator car for an elevator system with a battery installed therein.

Referring now to FIGS. 3 and 4, the batteries 40 are removable from the floor 34 for periodic activities such as inspection, service and/or replacement. To facilitate easy removal and installation of the batteries 40, the each battery 40 may include a handle 48 secured to the battery 40. In other embodiments, the handle 48 may be formed into the battery 40 rather than installed to the battery 40 as a separate piece. As shown, the battery 40 may be removed from the battery pocket 42 by translating the battery 40 horizontally. It is to be appreciated, however, that in other embodiments the battery 40 may be removed from the battery pocket 42 vertically and/or rotationally.

Figure 5:
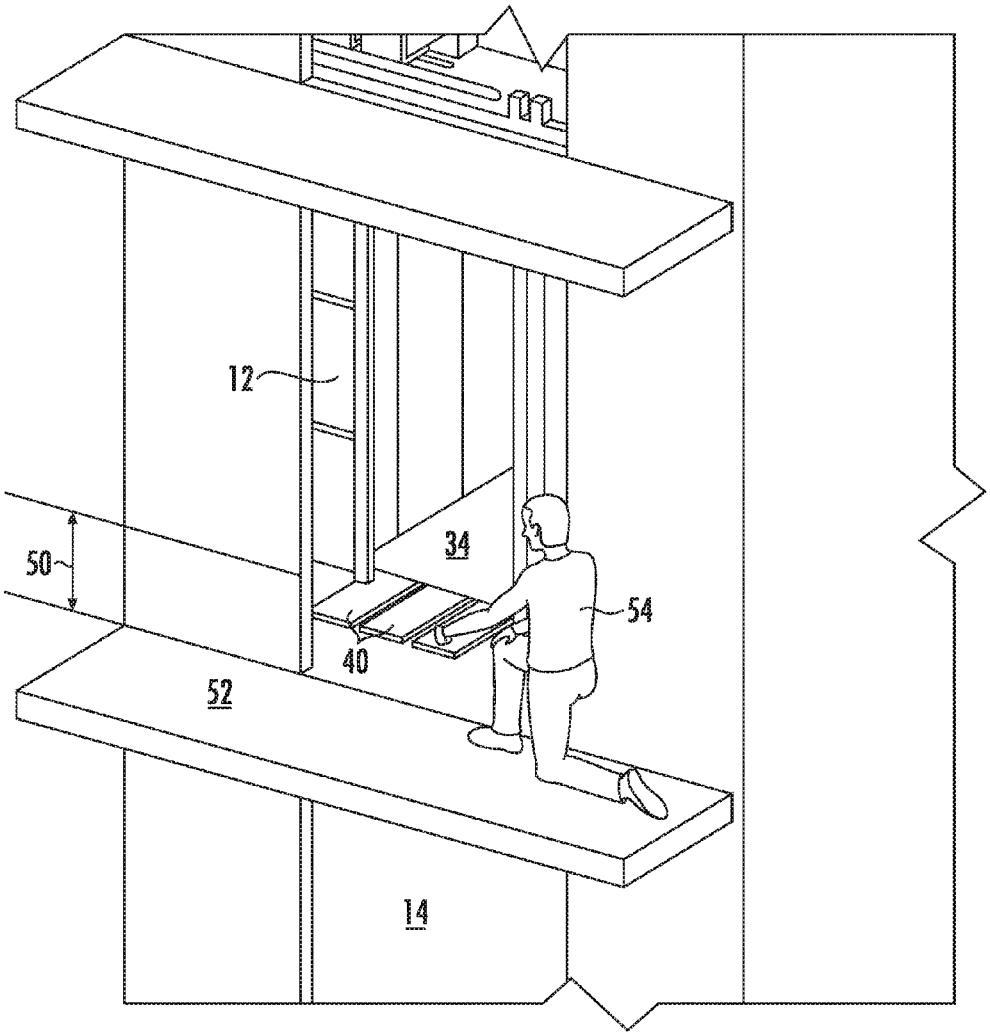
FIG. 5 is an illustration of a method of performing maintenance on an elevator car of an elevator system.

Referring now to FIG. 5, a method for battery 40 service and/or replacement will be now described. The elevator car 12 is driven along the hoistway 14 until the floor 34 of the elevator car 12 is positioned a distance 50 above a selected landing floor 52. A technician 54 at the landing floor 52 has access to the batteries 40 and may remove the batteries 40 from the battery pockets 42 for service and/or replacement. Once the service operations are complete, the technician 54 then is able to reinsert the batteries 40 into the battery pockets 42. Then, normal operation of the elevator system 10 may be resumed.

The service and/or replacement of the batteries 40 is accomplished without the technician entering the hoistway 14, eliminating a need for a safety volume and clearance space in the hoistway 14 for performing battery 40 maintenance, thus potentially reducing a size of the hoistway 14. Further, the batteries 40 are not located in the hoistway 14 but are installed at the elevator car 12 itself. This allows for more efficient use of hoistway 14 space, with fewer components located in the hoistway 14.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. An elevator car for an elevator system comprising:
an elevator car panel;
at least one battery pocket disposed in the elevator car panel; and
at least one battery removably positioned in the at least one battery pocket, configured such that one or more of inspection, maintenance, replacement or repair of the at least one battery may be performed without entry into a hoistway and the elevator car of the elevator system.

2. The elevator car of claim 1, wherein the at least one battery pocket is disposed at a floor panel of the elevator car.

3. The elevator car of claim 1, wherein multiple batteries are disposed at the elevator car panel.

4. The elevator car of claim 1, wherein the at least one battery supplies electrical power to the elevator car.

5. The elevator car of claim 4, wherein the electrical power is for one or more of elevator car drive, lighting or control systems.

6. An elevator system comprising:
a hoistway; and
an elevator car suspended in the hoistway via a suspension member and drivable along the hoistway, the elevator car including:
an elevator car panel;
at least one battery pocket disposed in the elevator car panel; and
at least one battery removably positioned in the at least one battery pocket, configured such that one or more of inspection, maintenance, replacement or repair of the at least one battery may be performed without entry into the hoistway and the elevator of the elevator system.

7. The elevator system of claim 6, wherein the at least one battery pocket is disposed at a floor panel of the elevator car.

8. The elevator system of claim 6, wherein the at least one battery is removable from the at least one battery pocket by a technician at a landing floor of the elevator system.

9. The elevator system of claim 6, further comprising a handle disposed at the at least one battery for removal of the at least one battery from the at least one battery pocket.

10. The elevator system of claim 6, wherein multiple batteries are disposed at the elevator car panel.

11. The elevator system of claim 6, wherein the at least one battery supplies electrical power to the elevator car.

12. The elevator system of claim 11, wherein the electrical power is for elevator car lighting, drive and/or control systems.

13. A method of servicing an elevator system comprising:
driving an elevator car along a hoistway;
stopping the elevator car near a selected elevator landing floor; and
at least partially removing at least one battery from at least one battery pocket at the elevator car via a technician located at the selected elevator landing floor without entry into the hoistway and the elevator car for one or more of inspection, maintenance, replacement or repair.

14. The method of claim 13, further comprising:

stopping the elevator car a distance above the selected elevator landing floor; and at least partially removing the at least one battery from the at least one battery pocket disposed at a floor panel of the elevator car for one or more of inspection, maintenance, replacement or repair.

15. The method of claim 13, wherein the at least one battery supplies electrical power to the elevator car for one or more of lighting, drive or control systems.

* * * * *